US008919255B1

(12) United States Patent
Quintana et al.

(10) Patent No.: US 8,919,255 B1
(45) Date of Patent: Dec. 30, 2014

(54) CHEMILUMINESCENT SHOTGUN TRACER INSERT WITH DECELERATOR

(71) Applicants: Mauricio F. Quintana, Glastonbury, CT (US); James Alfred Dunnam, Austin, TX (US)

(72) Inventors: Mauricio F. Quintana, Glastonbury, CT (US); James Alfred Dunnam, Austin, TX (US)

( * ) Notice: Subject to any disclaimer, the term of this patent is extended or adjusted under 35 U.S.C. 154(b) by 0 days.

(21) Appl. No.: 13/926,890

(22) Filed: Jun. 25, 2013

(51) Int. Cl.
*F42B 12/38* (2006.01)

(52) U.S. Cl.
CPC ..... *F42B 12/38* (2013.01)
USPC ..... 102/513; 102/458; 102/449

(58) Field of Classification Search
CPC ..... F42B 12/40; F42B 12/38; F42B 12/50; F42B 12/56; F42B 12/36; C09K 11/07; F21K 2/06
USPC ..... 102/513, 501, 448–449, 457–459
See application file for complete search history.

(56) References Cited

U.S. PATENT DOCUMENTS

| | | | | |
|---|---|---|---|---|
| 3,234,877 | A | 2/1966 | Herter | |
| 3,565,010 | A * | 2/1971 | Sahlmann et al. | 102/453 |
| 3,722,420 | A * | 3/1973 | Herter | 102/451 |
| 3,788,224 | A | 1/1974 | Merritt | |
| 3,812,784 | A * | 5/1974 | Herter | 102/451 |
| 3,974,775 | A | 8/1976 | Kerzman et al. | |
| 4,291,625 | A * | 9/1981 | Stagg, Jr. | 102/449 |
| 4,434,718 | A | 3/1984 | Kopsch et al. | |
| 4,553,481 | A * | 11/1985 | Ricci | 102/458 |
| 4,627,356 | A * | 12/1986 | Buczkowski | 102/453 |
| D365,867 | S * | 1/1996 | Flanagan | D22/116 |
| 6,260,484 | B1 * | 7/2001 | Billings | 102/453 |
| 6,615,739 | B2 * | 9/2003 | Gibson et al. | 102/513 |
| 7,228,801 | B2 * | 6/2007 | Dunnam et al. | 102/458 |
| 7,487,728 | B2 * | 2/2009 | Cranor | 102/513 |
| 7,610,857 | B1 | 11/2009 | Dunnam et al. | |
| 7,926,424 | B1 * | 4/2011 | Quintana et al. | 102/458 |
| 8,001,903 | B1 | 8/2011 | Quintana et al. | |
| 8,220,393 | B2 * | 7/2012 | Schluckebier et al. | 102/448 |
| 8,555,785 | B2 * | 10/2013 | Cross | 102/451 |
| 2013/0055916 | A1 * | 3/2013 | Menefee, III | 102/334 |
| 2013/0055917 | A1 * | 3/2013 | Menefee, III | 102/334 |
| 2013/0228090 | A1 * | 9/2013 | Billings | 102/457 |

* cited by examiner

*Primary Examiner* — Bret Hayes
*Assistant Examiner* — Joshua Freeman
(74) *Attorney, Agent, or Firm* — Mary J. Gaskin

(57) ABSTRACT

A chemiluminescent tracer insert with decelerator for use with a shotgun shell to provide an aiming and training aid for shotgun shooting activities, including skeet, trap, sporting clays, hunting, law enforcement and military applications. The tracer insert can be used in shotgun shells of all gauges. The tracer insert comprises a translucent, resilient, elastic, cylindrical container in which the reactants, an oxalate and fluorescent-colored dye solution, and an activator encased in a glass vessel, are held. Ignition of the shell causes the glass vessel to break. The resulting chemiluminescent reaction causes emission of light visible to the shooter. Unattached ends of thin-flaps on the tracer insert extend outwardly when drag forces act upon them during flight, slowing the speed of the tracer insert, which makes it more visible to the shooter, thereby providing a consistent reference to enable a shooter to make corrections to his lead and/or shooting techniques.

10 Claims, 5 Drawing Sheets

CHEMILUMINESCENT SHOTGUN TRACER INSERT WITH DECELERATOR

FIELD OF THE INVENTION

The present invention relates to shotgun ammunition, more specifically tracers used to make the shot visible to those engaging in a shotgun activity like skeet, trap, sporting clays, and hunting, and for use in law enforcement and military applications as standard ammunition or as a training aid.

BACKGROUND OF THE INVENTION

Effectively striking moving targets with shotgun ammunition requires the shooter to lead the object so that the projectile intercepts the target. Mastering the lead is difficult to accomplish, and requires practice and patience. The present invention enables the shooter to learn to effectively lead the target by using a tracer that is effective in a distance ranging from approximately 10 to 100 meters.

The visibility of an object to the human eye generally depends on the size, distance, speed, color/brightness of the object and atmospheric conditions. Inventors have developed tracers for shotgun shells in an attempt to aid the shooter in visualizing their shot with regard to the target.

Prior tracers can be categorized as non-ignition and ignition type. This invention relates to non-ignition type tracers and, more specifically, chemiluminescent tracers. Prior designs, like those disclosed in U.S. Pat. No. 7,610,857 by the present inventors, use a chemiluminescent platform to produce a trace. Because the brightness of the chemiluminscent reaction is typically constrained by the shelf life requirements of the ammunition, wherein the brighter the chemistry the shorter the shelf life, prior art chemiluniscent tracers are often not bright enough to be seen by the shooter other than in low-light conditions. Most efforts by manufacturers to date have been focused in improving the chemistry with catalysts and the like, in order to accelerate the reaction and/or make it brighter, while maintaining the minimum shelf life requirements dictated by customers. Furthermore, the ballistics of the tracer in U.S. Pat. No. 7,610,857 is such that it travels with the shot for well over 200 meters at speeds typically greater than 330 m/s (1000 ft/s). The speed requirement for shotgun ammunition is driven by the perception that, at higher speeds, the lead is reduced significantly (making it "easier" to hit a moving target) and that a certain speed is required to break a clay target or down a live target (dove, duck, geese, etc.)

Because an object that is stationary or traveling at low speed is more easily visible than one that is traveling at high speed, a simple solution to improve the visibility of an object is to slow it down so the human eye can track it more easily. For tracers, one option is to reduce the amount of propellant in the shotgun cartridge. However, this reduces both the speed of the shot and the speed of the tracer, which creates concerns for shooters, since the shot may travel too slowly to be effective. The present invention overcomes this problem by increasing the air drag/friction on the tracer insert in order to slow it down and make it more visible, without losing accuracy or slowing the shot. The present invention can be used in shotgun shooting ranging from approximately 10 to 70 meters. Further, because the tracer's range is greatly limited, safety concerns are reduced as to any lethal effect of the round in the event of an accident.

Essentially two forms of braking (or drag) forces affect an object during flight: one is caused by friction along the surface of the object; and the other is caused by the dynamic pressure that acts on the projected area of the object perpendicular to the flight path as the object displaces fluid during flight. In the former case, the drag force is proportional to the viscosity of the fluid (air in this case), to the speed of the fluid, to the surface roughness of the object, and to the surface area of the object that is exposed to the flow stream. In the latter case, the drag force is directly proportional to the square of the speed of the fluid and to the projected area of the object; in the case of cylindrical objects, the dynamic drag (or braking) force is therefore proportional to the square of the diameter of the object. In the present invention, both types of drag forces are present, but, because of the high speeds involved and the short flight paths, surface drag forces are smaller than the dynamic pressure forces, and, therefore, this invention relates to the means of increasing the dynamic pressure forces acting on a shotgun tracer to slow it down and thereby make it more visible to the shooter. Ultimately, the level of deceleration achieved is defined by the ratio between the drag force and the mass of the object; in other words, the higher the drag force, the higher the deceleration rate, and the larger the mass of the object, the lower the deceleration rate.

There are several inventions that incorporate a decelerator into a shotgun shot holder (also referred to as a wad). These inventions include U.S. Pat. No. 3,234,877 to Herter; U.S. Pat. No. 3,788,224 to Merritt; U.S. Pat. No. 3,974,775 to Kerzman et al.; and U.S. Pat. No. 4,434,718 to Kopsch et al. In all these patents, the shot holder, or wad, carries the payload, which can be shot-pellets, a sabot or slug, as it travels in the shotgun barrel, protecting the barrel from wear. The walls of the wad are pre-sliced, so that when the wad enters the air stream, its walls extend completely, but not evenly, stopping the wad a short distance from the muzzle of the shotgun, thus allowing the wad to separate from its payload without affecting the trajectory of the payload as it travels towards its intended target. Because the purpose of the sliced walls of the wad is to stop it as soon as possible so that it separates from its payload, the accuracy of the actual trajectory of the wad is erratic and largely irrelevant. The present invention is very different from such prior art since it has a very different application than slowing down a wad (or shot holder) as it carries the payload while traveling through the shotgun barrel, then separating during flight. The present invention, on the other hand, describes a tracer insert, which incorporates a decelerator in the form of several integrated thin-flaps, which, together with the shot pellets, is carried in a wad. Upon firing, the thin-flaps are evenly deployed to slow down the tracer insert during flight, thereby making the tracer visible to the shooter by accurately reflecting the trajectory of the shot in the effective range.

SUMMARY OF THE INVENTION

The present invention provides a chemiluminescent tracer insert holding chemiluminescent material which, when incorporated into a shotgun shell, can be used to provide a shooter with a consistent reference to correct the lead and shooting technique. This invention serves as a training aid or as standard ammunition to improve a shooter's accuracy for shotgun activities, including trap, skeet, sporting clays, hunting, law enforcement and military applications. The invention incorporates components of a known chemiluminescent reaction. The invention described herein can be modified and adjusted for use with all shot types, and it can be used in all shotgun gauges, shotgun types and applications. Given its simplicity, this invention can also be incorporated into high-volume, commercial shotgun ammunition-loading machines.

In accordance with the present invention a shotgun tracer shell comprises a tracer insert comprising a translucent cylindrical container holding liquid reactants which, when mixed, cause a chemiluminescent reaction, resulting in the emission of light. The container is made from a resilient, elastic, translucent material, such as polypropylene, polyethylene, polycarbonate, or nylon. The diameter, length, weight and shape of the tracer insert can be modified for different shotgun gauges, shot types and shot speeds. The tracer insert can be manufactured from readily-available materials (including plastics) using standard high-volume processes, including injection-molding machines. The tracer insert is loaded into a shotgun shell, above the shot cup so that it sits in front of the shot, separated therefrom by an optional spacer in order to ensure the accuracy of the tracer insert.

The container carries the components of a chemiluminescent reaction: an activator, such as hydrogen peroxide; and an oxalate, such as phenyl oxalate ester; and a colored fluorescent dye solution. The reactants are separated by having either one or both of the reactants contained inside frangible glass vessels, which break when the shell is fired, allowing the reactants to mix. The resulting reaction causes the release of energy to the fluorescent dye, exciting its atoms, resulting in the release of photons (light), which makes the insert visible. The tracer insert is formed with an integrated decelerator to slow down the tracer insert and make it visible to the shooter. The decelerator, which is made from the same material as the container and is integrally formed during the injection molding process, comprises a plurality of thin-flaps of predetermined length, width, and thickness, depending on the shot speed and application. The thin-flaps are formed on the outer surface of the container, symmetrically arranged with respect to the centerline of the tracer insert. One end of each of the thin-flaps is part of the surface of the container, while the other end is free. When the shotgun is fired and the insert is expelled into the atmosphere, the free ends of the thin-flaps will extend outwardly evenly from the surface of the container and curl backwards due to the drag (dynamic pressure) forces acting on them, thereby increasing the area perpendicular to the flight path of the insert, which in turn increases the drag forces acting on the insert, thus reducing its speed. The projected area of the thin-flaps comprising the decelerator is approximately 25-50% of the projected area of the tracer insert without the decelerator.

In theory, the same braking effect on the tracer insert can be achieved using either a small number of large, symmetrically-placed thin-flaps or a large number of small, symmetrically-placed thin-flaps, so long as the total projected areas is the same. However, experiments have shown that a larger number of small thin-flaps will likely result in better performance. The reason for this is that, when using a larger number of thin-flaps, because each thin-flap has a smaller projected area, if during flight, one of these thin-flaps fails to extend outwardly, the tracer insert flight path will not be impacted significantly. On the other hand, when a small number of large thin-flaps are used, because each thin-flap will have a larger projected area, if one fails to extend outwardly, the device will yaw, causing the tracer insert to deviate from its intended flight path.

In either case, the decelerator increases the level of turbulence surrounding the insert which, in turn, induces flutter in the extended thin-flaps which, in turn, causes the insert to vibrate, thereby increasing the mixing of the chemiluminescent reactants, resulting in more photons being released and making the tracer insert to appear brighter.

It is an object of the present invention to provide a chemiluminescent tracer insert having a decelerator that slows its speed during flight in order to make the tracer insert more visible to a shooter.

Another object of the present invention is to provide a decelerator that acts without affecting the accuracy of the tracer.

Yet another object of the present invention is to provide a decelerator that comprises thin-flaps extending outwardly from the cylindrical surface of the tracer insert.

A still further object of the present invention is to provide a decelerator that restricts the range of a tracer insert, thereby improving its safety.

Further objects and advantages of this invention will become apparent from a consideration of the drawings and description, infra

DESCRIPTION OF THE PREFERRED EMBODIMENT

The present invention is designed to be used with a typical shotgun shell 1, which generally has a hull 2 with a metal base cap 3 and a crimped top 4.

Figure 1:
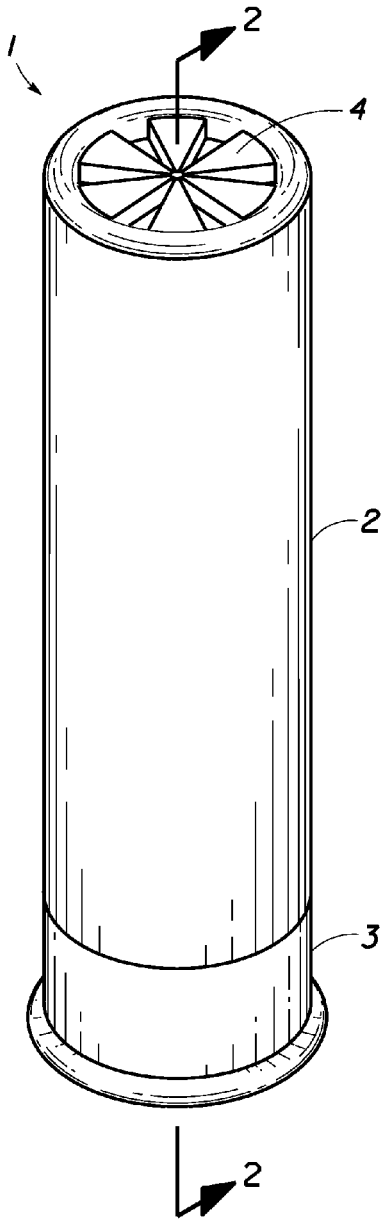
FIG. 1 is an isometric view of a shotgun shell containing the chemiluminescent tracer insert with decelerator of the present invention.
Figure 2:
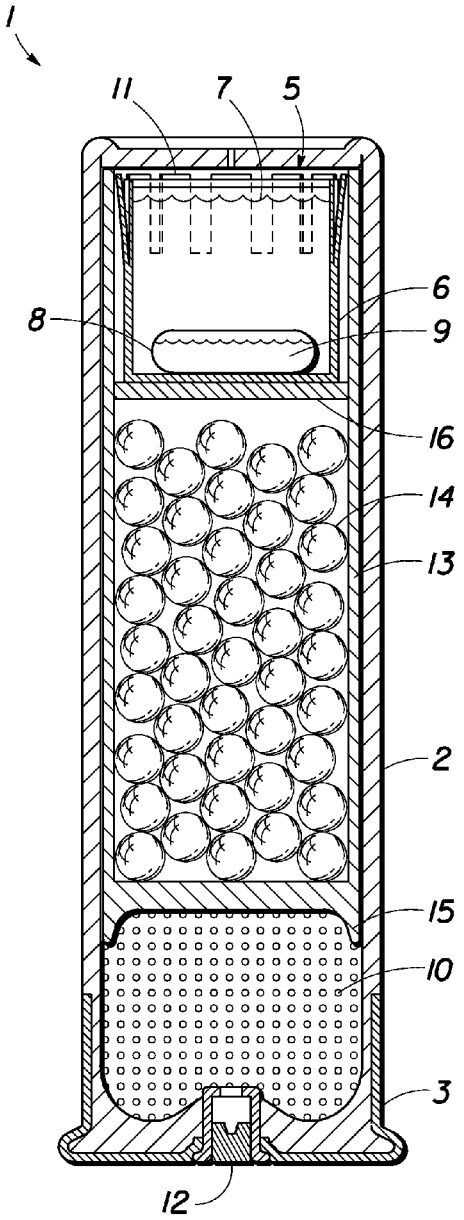
FIG. 2 is a sectional side view of the shotgun shell containing the chemiluminescent tracer insert with decelerator, taken along line 2-2 in FIG. 1.
Figure 3:
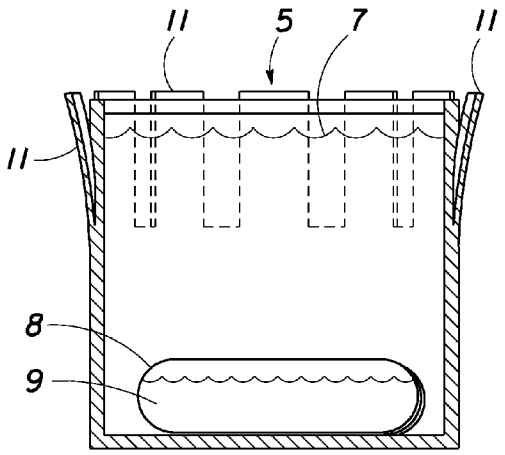
FIG. 3 is an enlarged sectional view of the chemiluminescent tracer insert with decelerator shown in FIG. 2, before it is fired and subjected to air drag forces.

The sectional view in FIG. 2 (a portion of which is enlarged in FIG. 3) shows a shotgun shell 1 which has been assembled with the chemiluminescent tracer insert with decelerator 5 located inside the upper end of the shotgun shell 1. The chemiluminescent tracer insert with decelerator 5 can be manufactured from readily-available materials using standard high-volume processes, including injection-molding machines. The tracer insert 5 comprises a cylindrical container 6 that is made from a resilient, elastic, translucent material, such as polypropylene, polyethylene, polycarbonate, or nylon. The diameter, length, weight and shape of the tracer insert can be modified for different shotgun gauges, shot types and shot speeds. The cylindrical container 6 holds two reactants: (1) an oxalate, such as phenyl oxalate ester, with a colored fluorescent dye solution (hereinafter called coxalate-fluorescent dye solution 7), and (2) a glass vessel 8 holding an activator 9, such as hydrogen peroxide. Formed on the outer cylindrical surface of the container 6 are thin-flaps 11, which are symmetrically arranged with respect to the centerline of the tracer insert. The thin-flaps 11 are an integral part of container 6 and act as a decelerator. One end of each of the thin-flaps 11 is part of the surface, while the other end is free. The free ends of the thin-strips 11 are designed to peel away from the surface of the container 6 and extend evenly outwardly when subjected to drag forces after the tracer insert 5 is in flight. The propellant 10 contained in the lower end of the shotgun shell 1 is ignited by the primer 12 inside the base cap 3. Located above the propellant 10 is the shot cup 13 (or shot holder), which has been partially filled with shot pellets 14. The shot pellets 14 can be made of conventional material like lead or steel pellets and other materials like plastic, bismuth or tungsten alloys. The shot cup 13 can be formed to have a gas seal 15 at its lower end, as shown, in order to contain the gases during their expansion after the propellant 10 has been ignited. Alternatively, a gas seal can be constructed as a separate piece and placed below the shot cup 13. A disk-shaped spacer 16, made of conventional materials including plastic, cardboard, or cork, can be added into the shot cup 13 above the shot pellets 14, in order to protect the chemiluminescent tracer insert with decelerator 5 from the shot pellets 14 and ensure accuracy. The chemiluminescent tracer insert with decelerator 5 is loaded into the shot cup 13 above the spacer 16 and should fit snugly inside the shot cup 13 for proper accuracy. The free ends of the thin-flaps 11 peel away from the surface of the container 6 once the tracer insert 5 is in flight due to the drag forces acting on the insert 5. As the free ends of the thin-flaps 11 extend outwardly in flight, the increased drag forces decelerate the tracer insert 5, slowing its speed and thus making it more visible to the shooter.

Figure 4:
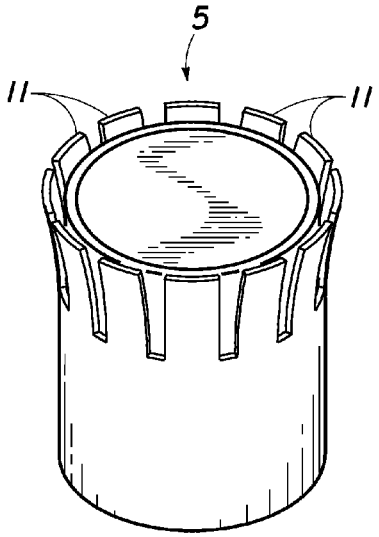
FIG. 4 is an isometric view of the chemiluminescent tracer insert with decelerator before it has been fired.

Shown in FIG. 4 is an isometric view of the chemiluminescent tracer insert with decelerator 5 in flight with free ends of the thin-flaps 11 extending outwardly evenly due to the drag forces acting on them. The increased drag resulting from the increased area of the extended thin-flaps 11 increases the air turbulence surrounding the tracer insert 5 and induces flutter (vibration) in the thin-flaps 11, which in turn causes the tracer insert 5 to oscillate, thereby increasing the mixing of the chemiluminescent reactants 7 and 8, which, in turn, increases the number of photons emitted and the tracer insert's 5 visibility to the shooter or observer.

Figure 5:
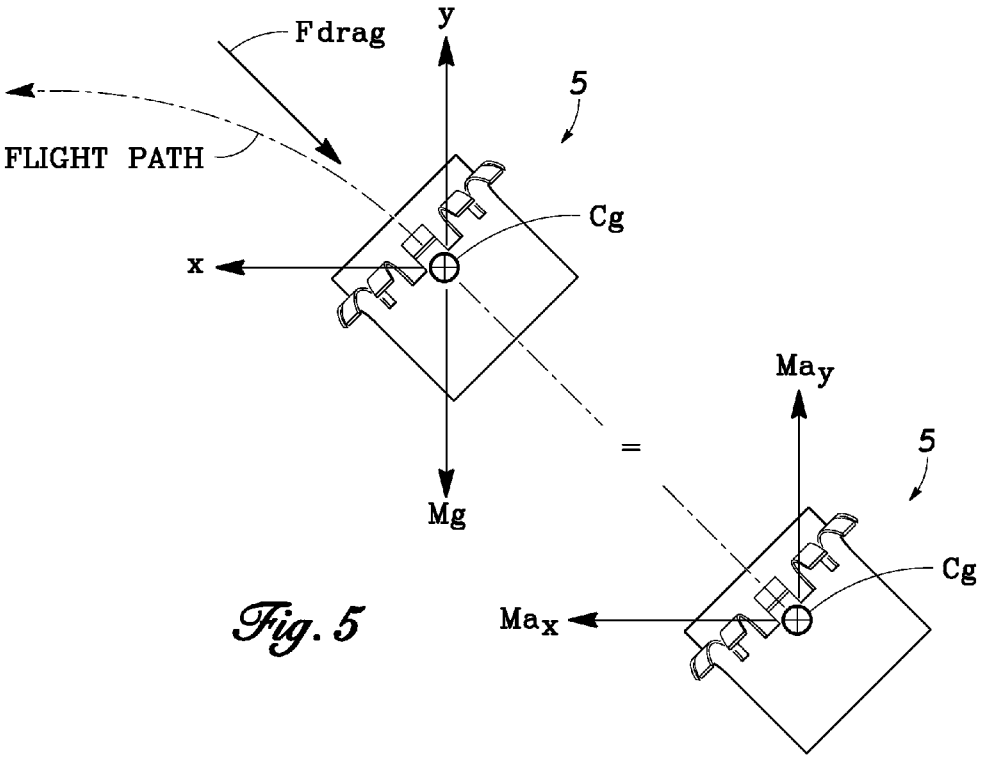
FIG. 5 shows a free body diagram of the forces acting on the insert with decelerator during flight, with the thin-flaps extended and peeled away from the container.

FIG. 5 shows a free body diagram of the tracer insert with decelerator 5 during flight, where gravity and drag forces are the primary external forces acting on the tracer insert 5. As can be seen in FIG. 5, the center of gravity (CG) of the tracer insert 5 is kept close to the nose, making it "top heavy" so that the tracer insert 5 has adequate stability during flight. This is achieved by adding mass to the upper section of the insert 5 during manufacturing.

Figure 6:
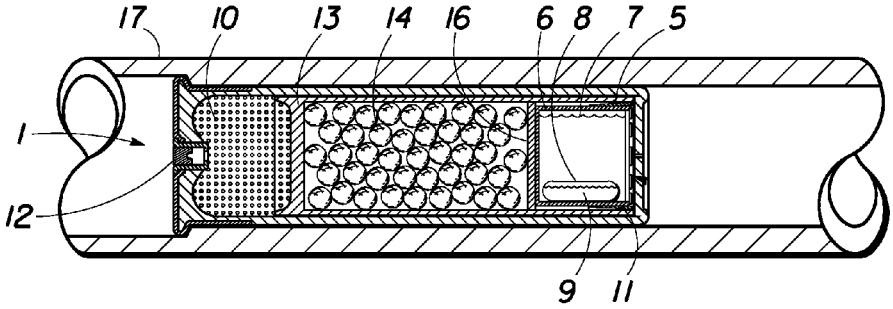
FIGS. 6, 7 and 8 are sectional side views showing the positions of the chemiluminescent tracer insert with decelerator with respect to the shotgun barrel before, during, and after ignition.
Figure 7:
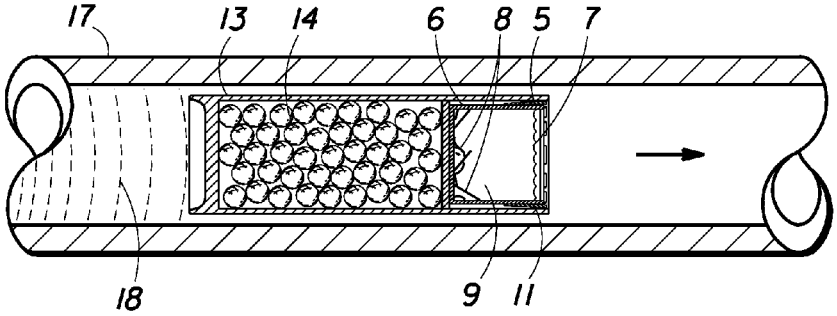
Figure 8:
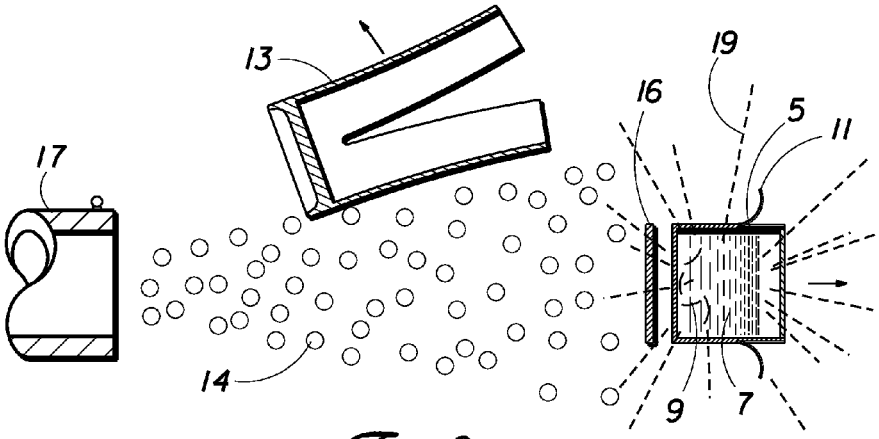

FIGS. 6-8 show the movement of the chemiluminescent tracer insert with decelerator 5, before, during, and after ignition of the shotgun shell.

In FIG. 6, the shotgun shell 1, containing a shot cup 13 with shot pellets 14, has been loaded into the shotgun barrel 17. A spacer 16 is placed into the shot cup 13, above the shot pellets 14. The chemiluminescent tracer insert with decelerator 5 holds the oxalate-fluorescent dye solution 7 and the activator 9 (encased in glass vessel 8) in the resilient, elastic container 6. The primer 12 will ignite the propellant 10, and gasses will expand against the lower end of the shot cup 13.

In FIG. 7, the explosive movement of the expanding gases 18 of ignition propel the shot cup 13 with shot pellets 14, and chemiluminescent tracer insert with decelerator 5 holding the reactants through the shotgun barrel 17, simultaneously breaking the glass vessel 8 holding the activator 9, allowing the activator 9 to mix with the oxalate-fluorescent dye solution 7 in the container 6. The reaction results in the release of energy and excitation of the atoms in the fluorescent dye, resulting in the release of light, or photons (the process of chemiluminescence), making the insert 5 highly visible to the shooter.

In FIG. 8, after leaving the shotgun barrel 17, the shot cup 13 has flipped out of the way of the scattering shot pellets 14, and the free ends of the thin-flaps 11 (the decelerator) have extended outwardly due to the drag forces acting on them, slowing the chemiluminescent tracer insert with decelerator 5 and thus making it more visible to the shooter. The translucent chemiluminescent tracer insert with decelerator 5, carrying the reacting oxalate-fluorescent dye solution 7 and activator 9 and emitting visible luminescence 19, continues its trajectory in front of the shot pellets 14 and spacer 16.

Figure 9:
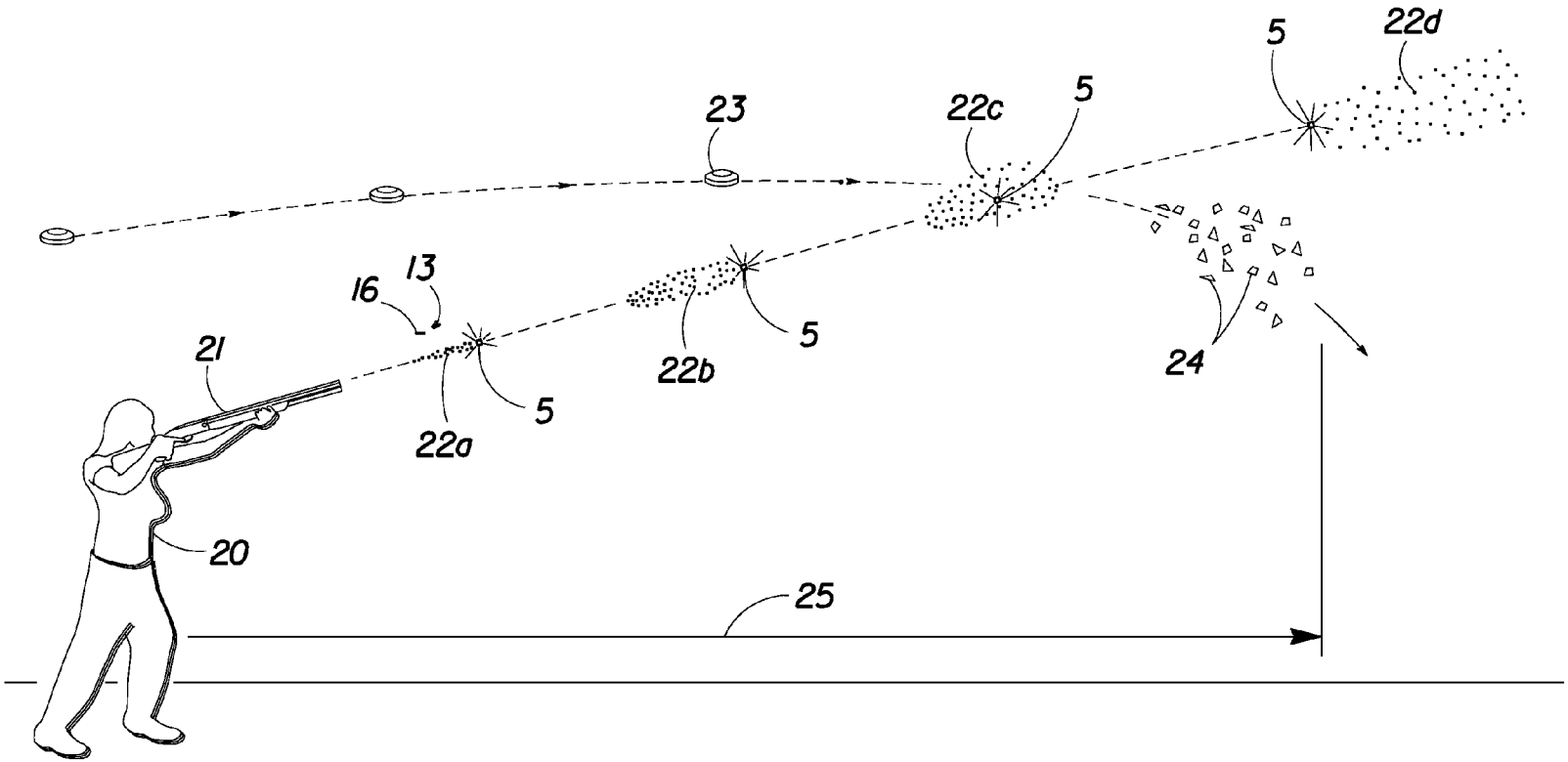
FIG. 9 is a representational view of a shooter using the chemiluminescent tracer insert with decelerator of the present invention while shooting at a clay target.

FIG. 9 shows a shooter 20 using the chemiluminescent tracer insert with decelerator 5 of the present invention. The shooter has loaded his shotgun 21 as he would load any other ammunition. The shooter has aimed in front of the clay target 23 and has fired. The chemiluminescent tracer insert with decelerator 5 has left the shotgun barrel 15 as the patterns of the shot string 22A, 22B, 22C, 22D expands, the thin-flaps 11 of the chemiluminescent tracer insert with decelerator 5 have extended outwardly due to the drag forces acting on them and thus decelerate the tracer insert to make it more visible to the shooter. The shot cup 13 has flipped out of the way and the spacer 16 (optional) has fallen. If the shooter 20 hits the clay target 23, it breaks into pieces 24. If he misses the clay target 23, the shooter 20 would correct his lead or aiming point, according to the relative position of the chemiluminescent tracer insert with decelerator 5 to the clay target 23. FIG. 9 also shows how the insert with decelerator 5 is in front of the shot 22 upon its launch and, depending on shot size, muzzle speed, insert mass, and decelerator characteristics, the shot 22 could eventually catch up to the insert with decelerator 5 and overcome it at a distance 25. The insert with decelerator 5 can be designed so the shot 22 overcomes it (shown) or not (not shown), depending on the brightness of the chemiluminescent reaction and, therefore, the speed reduction required of the insert 5 to make it visible, or even more visible. If the chemiluminescent reaction is bright enough, the insert with decelerator 5 can be designed so that it slows down only slightly for improved visibility, but stays in front of the shot 22 in the effective range. In the case where the chemiluminescent reaction is not bright enough, the insert with decelerator 5 would need to be slowed down significantly by having a decelerator 11 with more or larger thin-flaps in order to increase the deceleration rate of the tracer 5, or the mass of the insert could be reduced if an additional mass has been added in the nose, so that, by keeping the decelerator the same, the reduction in the mass of the insert would result in a lower energy projectile that will decelerate more quickly. These type of adjustments will depend on the application. In this case, it is likely that the shot string 22 will overcome the insert with decelerator 5 but, as shown in FIG. 9, the shot string density 22*a*, 22*b*, 22*c* and 22*d* declines as the space between individual pellets 13 increases during flight so that the insert with decelerator 5 does not materially deviate from its intended flight path when the shot string 22 overcomes it.

Care should be used when storing the shells 1, which contain the chemiluminescent tracer insert with decelerator 5 of the present invention, since exposure to ultraviolet light could cause the oxalate-fluorescent dye solution 7 and the activator 9 to degrade. For instance, a box of the shells 1 may be enclosed with an opaque material such as aluminum foil, cardboard, or an opaque plastic.

Figure 10:
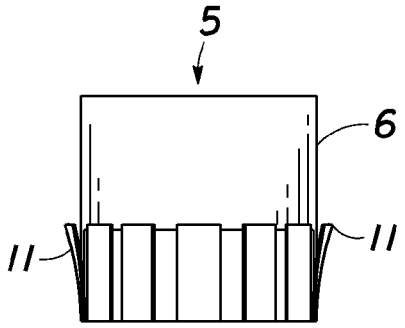
FIGS. 10-12 show different embodiments of the tracer insert with decelerator of the present invention.
Figure 11:
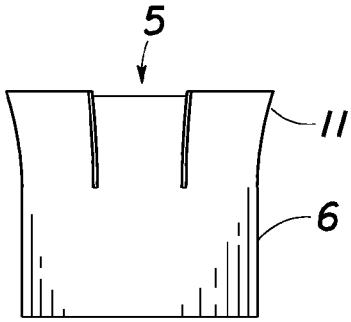
Figure 12:
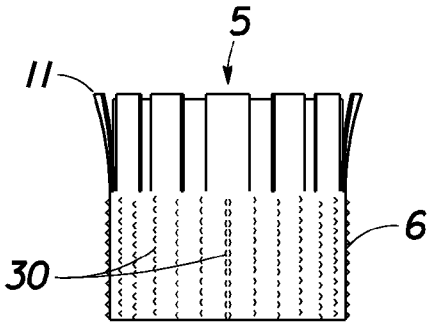

As shown in FIGS. 10-12, the tracer insert with decelerator 5 can be fitted with different types or sizes of thin-flaps 11 in order to create the desired braking effect of the tracer insert 5 during flight.

For example, FIG. 10 shows the tracer insert 5 with the extendable thin-flaps 11 formed on the lower portion of container 6. The thin-flaps 11 can also be placed on any portion of the surface of the cylindrical container 6, as long as they are placed symmetrically with respect to the center line of the tracer insert 5.

FIG. 11 shows a tracer insert 5 with a smaller number of larger thin-flaps 11.

FIG. 12 shows the tracer insert 5 with a rough surface finish 30, which increases the air drag forces, which may be desirable, depending on the application.

Although the description contains many specifics, these should not be construed as limiting the scope of the invention, but merely as providing illustrations of some of the presently preferred embodiments of this invention. Thus, the scope of the invention should be determined by the appended claims and their legal equivalents, rather than by the examples given.

We claim:

1. A chemiluminescent tracer insert for use with a shotgun shell having a lower end and an upper end, and further having propellant and a shot cup having a first end and an opposing second end and holding shot, the propellant being contained inside the lower end of the shotgun shell below the second end of the shot cup, the tracer insert having a centerline and comprising a resilient, elastic, translucent cylindrical container holding a first reactant, a second reactant, a fluorescent dye, and means for physically separating the first reactant from the second reactant and the fluorescent dye prior to their combination resulting in a chemiluminescent reaction, the tracer insert located inside the upper end directly under the crimped top of the shotgun shell, inside the first end of the shot cup and above the shot held in the shot cup, the cylindrical container having an outer surface having a plurality of integral resilient, elastic thin-flaps, the thin-flaps being symmetrically arranged with respect to the centerline of the tracer insert, each thin-flap having an unattached free end, the tracer insert moving separately from the shot cup and the shot after leaving a shotgun barrel, the free ends of the thin-flaps configured to peel away from the cylindrical outer surface of the container, each of the free ends individually extending elastically outwardly evenly therefrom and curling backwards in a position perpendicular to the flow stream and resulting drag forces acting on the free ends while the tracer insert is in flight, resulting in an increased projected area of the plurality of thin-flaps as the ends of the thin-flaps extend radially with respect to the centerline of the container, the increased projected area perpendicular to the flight path of the insert resulting in an increase in the dynamic pressure drag forces acting on the tracer insert, the increased drag forces thereby decelerating the tracer insert.

2. The tracer insert of claim 1 wherein the container is made from a material selected from the group consisting of polypropylene, polyethylene, polycarbonate, and nylon.

3. The tracer insert of claim 1 wherein the first reactant is a hydrogen peroxide solution and the second reactant is a phenyl oxalate ester solution.

4. The tracer insert of claim 1 wherein the means for physically separating the first reactant from the second reactant and the fluorescent dye comprises at least one frangible glass container.

5. The tracer insert of claim 1 wherein a disk-shaped spacer is arranged under and adjacent to the tracer insert in order to separate the tracer insert from the shot held in the shot cup and thereby ensure accuracy when the tracer insert is in flight.

6. The tracer insert of claim 5 wherein the disk-shaped spacer is made from plastic, cardboard, or cork.

7. The tracer insert of claim 1 wherein the free-ends of the thin-flaps can be formed on the surface of the container on one end of the container or on a middle portion of the container.

8. The tracer insert of claim 1 wherein the thin-flaps on the surface of the container varies in quantity, length, width, and thickness, depending on a particular application.

9. The tracer insert of claim 1 wherein the surface of the container has a rough finish.

10. A chemiluminescent tracer insert for use with a shotgun shell having a lower end and an upper end, and further having propellant and a shot cup having a first end and an opposing second end and holding shot, the propellant being contained inside the lower end of the shotgun shell below the second end of the shot cup, the tracer insert having a center of gravity near the upper end and a centerline and comprising a resilient, elastic, translucent cylindrical container holding a first reactant, a second reactant, a fluorescent dye, and means for physically separating the first reactant from the second reactant and the fluorescent dye prior to their combination resulting in a chemiluminescent reaction, the tracer insert located inside the upper end directly under the crimped top of the shotgun shell, inside the first end of the shot cup and above the shot held in the shot cup, the cylindrical container having an outer surface having a plurality of integral resilient, elastic thin-flaps, the thin-flaps being symmetrically arranged with respect to the centerline of the tracer insert, each thin-flap having an unattached free end, the tracer insert moving separately from the shot cup and the shot after leaving a shotgun barrel, the free ends of the thin-flaps configured to peel away from the cylindrical outer surface of the container without shifting the center of gravity of the tracer insert, each of the free ends individually extending elastically outwardly evenly therefrom and curling backwards in a position perpendicular to the flow stream and resulting drag forces acting on the free ends while the tracer insert is in flight, resulting in an increased projected area of the plurality of thin-flaps as the ends of the thin-flaps extend radially with respect to the centerline of the container, the increased projected area perpendicular to the flight path of the insert, resulting in an increase in the dynamic pressure drag forces acting on the tracer insert, the increased drag forces thereby decelerating the tracer insert.

* * * * *